United States Patent [19]

Kanno et al.

[11] Patent Number: 4,881,066

[45] Date of Patent: Nov. 14, 1989

[54] ACTIVE MATRIX-TYPE DISPLAY PANEL

[75] Inventors: Hideo Kanno; Shinichi Yamashita, both of Kawasaki; Satoshi Omata, Tokyo; Masahiko Enari, Yokohama; Mitsutoshi Kuno, Kawasaki; Yoshiyuki Osada, Yokosuka, all of Japan

[73] Assignee: Canon Kabushiki Kaisha, Tokyo, Japan

[21] Appl. No.: 220,898

[22] Filed: Jun. 20, 1988

Related U.S. Application Data

[63] Continuation of Ser. No. 799,107, Nov. 18, 1985, abandoned.

[30] Foreign Application Priority Data

Nov. 19, 1984 [JP] Japan ..... 59-242268

[51] Int. Cl.[4] ..... G09G 3/00

[52] U.S. Cl. ..... 340/719; 340/784; 350/332

[58] Field of Search ..... 340/719, 784, 802, 805, 340/811; 350/332, 333

[56] References Cited

U.S. PATENT DOCUMENTS

| | | | |
|---|---|---|---|
| 3,564,135 | 2/1971 | Weimer | 340/719 |
| 3,862,360 | 1/1975 | Dill et al. | 340/719 |
| 4,112,333 | 9/1978 | Asars et al. | 340/719 |
| 4,345,249 | 8/1982 | Togashi | 340/719 |
| 4,386,352 | 5/1983 | Nonomura et al. | 340/719 |
| 4,499,459 | 2/1985 | Sasaki et al. | 340/789 |

*Primary Examiner*—Donald J. Yusko
*Assistant Examiner*—Mahmoud Fatahi Yar
*Attorney, Agent, or Firm*—Fitzpatrick, Cella, Harper & Scinto

[57] ABSTRACT

An active matrix type display panel comprising a first base plate, a second base plate, and a liquid crystal disposed therebetween. The first base plate has thin film transistors formed thereon in the form of a matrix. The second base plate has a counter electrode formed thereon. The source of the thin film transistor are connected to information signal input electrodes which form counter electrodes of capacitive elements for sampling-and-holding information signals.

6 Claims, 5 Drawing Sheets

ACTIVE MATRIX-TYPE DISPLAY PANEL

This application is a continuation of application Ser. No. 799,107, filed Nov. 18, 1985, now abandoned.

FIELD OF THE INVENTION AND RELATED ART

The present invention relates to an active matrix-type liquid crystal display panel wherein a plurality of thin film transistors (TFTs) are arranged in the form of a matrix.

For a liquid crystal panel having a large number of picture elements, there is generally used a base plate or electrode plate on which switching elements for controlling the luminance of respective picture elements, vertical electrodes (information signal input electrodes) provided with capacitive elements for holding image signals, and horizontal electrodes (scanning signal input electrodes) are disposed and connected so as to form a matrix.

FIG. 1 shows an example of such an electrode plate. Referring to FIG. 1, a switching element 1 for controlling the turning ON-OFF of a picture element comprises a plurality MOS-type TFT's (thin film transistors) arranged to form a matrix array. The sources S of the TFTs 1 arranged in a column are commonly connected to one of vertical electrodes $V_1$–$V_n$ supplying image signals. The drains D of the TFTs 1 are respectively connected to a picture element electrode 3 for applying an electric field to the liquid crystal 2, while the gates G of the TFTs 1 arranged in a row are commonly connected to one of horizontal electrodes $H_1$–$H_m$. A capacitor $C_H$ for holding image signals is connected to each of the vertical electrodes $V_1$–$V_n$, and a common electrode 4 disposed opposite to the counter electrodes 3 with the liquid crystal 2 therebetween is grounded.

In the above construction, an image signal stored in a capacitor $C_H$ for sampling-and-holding image signals is applied through a vertical electrode $V_1, \ldots$ or $V_n$ and a TFT 1 to a counter electrode 3 to write in a picture element, when the gate of a TFT is turned ON, i.e., when a voltage from a horizontal electrode $H_1, \ldots$ or $H_m$ reaches a prescribed selection level to place the source-drain of the TFT in continuity.

In a conventional apparatus as described above, it is necessary to provide capacitive elements having a prescribed electrostatic capacity for one horizontal scanning period. As a result, the panel structure becomes complicated and the number of process steps for production increases.

SUMMARY OF THE INVENTION

A principal object of the present invention is, in view of the problems as mentioned above, to provide a liquid crystal panel in which capacitive elements exclusively used for holding image signals are not needed and for which the number of production steps has been decreased through simplification of the structure. According to our study, it has been found very effective to use a capacitive component per se generated by the combination of a vertical electrode, the common electrode and a liquid crystal between the electrodes of a liquid crystal cell also as a capacitive element for holding image signals.

Thus, according to the present invention, there is provided, an active matrix-type display panel comprising a first base plate on which a plurality of thin film transistors are formed in the form of a matrix, a second base plate which is disposed opposite to and spaced from the first base plate and on which a counter electrode is formed, and a liquid crystal disposed between the first and second base plates. The sources of the thin film transistors are connected to information signal input electrodes which form counter electrodes of capacitive elements for sampling-and-holding information signals.

These and other objects, features and advantages of the present invention will become more apparent upon a consideration of the following description of the preferred embodiments of the present invention taken in conjunction with the accompanying drawings.

DETAILED DESCRIPTION OF PREFERRED EMBODIMENTS

Figure 1:
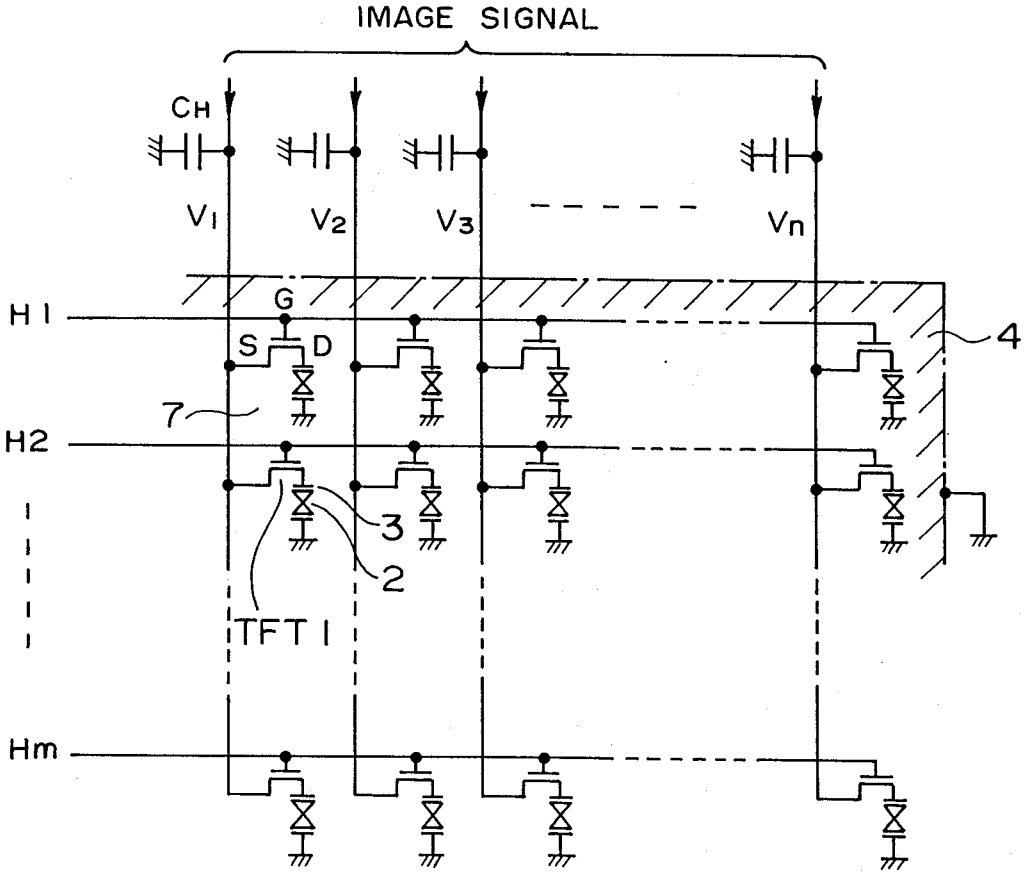
FIG. 1 is a circuit diagram illustrating a structural arrangement of a conventional liquid crystal display panel.

When the size of a capacitive component formed of liquid crystal between one vertical electrode (information signal input electrode) and an oppositely disposed common electrode is increased to a level 30 to 60 times as large as the liquid crystal capacitive element 2 of the picture element shown in FIG. 1, the sampling-and-holding capacitor $C_H$ used in a liquid crystal panel shown in FIG. 1 can be omitted.

Figure 2:
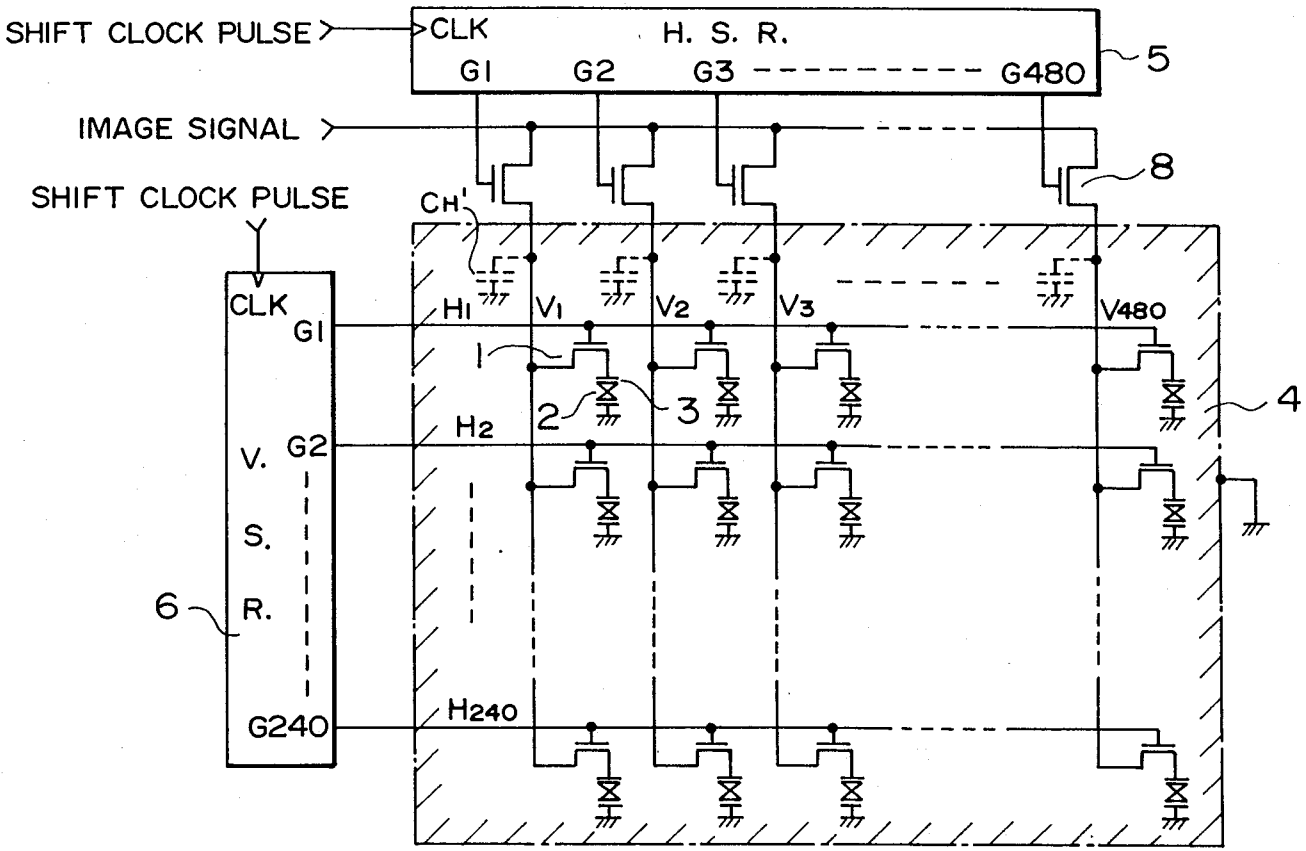
FIG. 2 is a circuit diagram illustrating an arrangement of an example of the liquid crystal display panel according to the present invention.

An embodiment of the present invention will now be explained with reference to FIG. 2. FIG. 2 schematically illustrates structural arrangement of a liquid crystal display panel according to the present invention. In the figure, reference numeral 8 denotes an analog switch preferably of the C-MOS type, to which switching pulses are supplied from a horizontal shift register 5 to turn ON and OFF the analog switches 8 in a time-division manner. TFTs 1 are preferably those comprising films of amorphous silicon semiconductor films driven by switching pulses from a vertical shift register 6. Between a vertical electrode $V_1, V_2, \ldots$ or $V_n$ and a common electrode 4 is formed a capacitive component $C_H'$. The liquid crystal panel shown in FIG. 2 may comprise 240 or more lines of horizontal electrodes (scanning signal input electrodes), 480 or more lines of vertical electrodes (information signal input electrodes) and accordingly $240 \times 480$ or more picture elements.

In a preferred embodiment according to the present invention, a high quality image display can be accomplished without using a sampling-and-holding capacitor $C_H$ as shown in FIG. 1, where an opposite area of one picture element formed by a pair of opposite electrodes (corresponding to the area of a picture element electrode 3) is made $1.2 \times 10^4\ \mu m^2$ to $1.5 \times 10^4\ \mu m^2$ and an opposite area formed by a pair of one vertical electrode and a common electrode 4 is made $6 \times 10^5\ \mu m^2$ to $10 \times 10^5\ \mu m^2$.

More specifically, in a specific embodiment according to the present invention, the width of the vertical electrode is made wider, preferably of the order of 1.2 to 2.0 times the vertical electrode width of the conventional liquid crystal panel shown in FIG. 1, or the vertical electrode width as used in the conventional example FIG. 1 may be used in a narrower width of picture element electrode 3 connected to TFT 1, preferably a width 0.67 to 0.5 times that used in FIG. 1.

Figure 3:
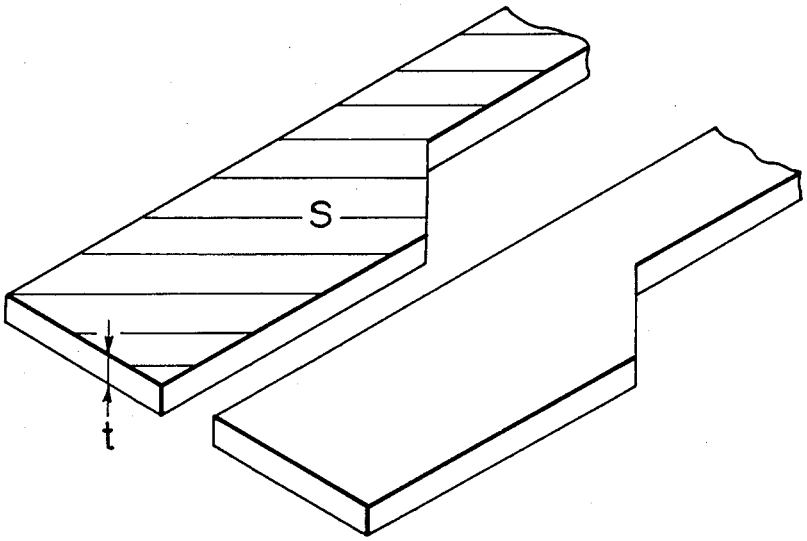
FIG. 3 is an enlarged view showing ends of vertical electrodes used in the present invention.

According to another embodiment, the value of the electrode capacitive component can be adjusted by changing the area S and/or thickness t of an end portion of a vertical electrode as shown in FIG. 3, and/or by changing the electrode material.

In the present invention, the capacitive component $C_H'$ formed at the liquid crystal between one vertical electrode and the opposite common electrode 4 may be made 3 to 10 pF, preferably 5 to 8 pF.

In the present invention, it is preferred to adjust the capacitance of the electrode capacitive element for sample-and-hold use to a value of the order of 10 pF by forming the vertical electrode as a counter electrode of the sample-and-hold capacitive element with a metal film such as an aluminum film, or a laminated film of an aluminum film and chromium film having a better conductivity than an ITO film. In a further preferred embodiment, a metal film such as an aluminum film or a laminated metal film such as an aluminum film and a chromium film may be disposed on the opposite common electrode in alignment with and in substantially the same width as the vertical electrode. In this instance, the metal films or laminated metal films formed on the common electrode in alignment with the vertical electrodes need not be insulated from each other but may be directly formed on the common electrode, e.g., of ITO (indium-tin-oxide) film formed on the whole surface by once forming such a metal film uniformly, e.g., by vapor deposition and selectively etching the uniform metal film to leave a desired pattern of the metal film or laminated metal film.

Figure 4:
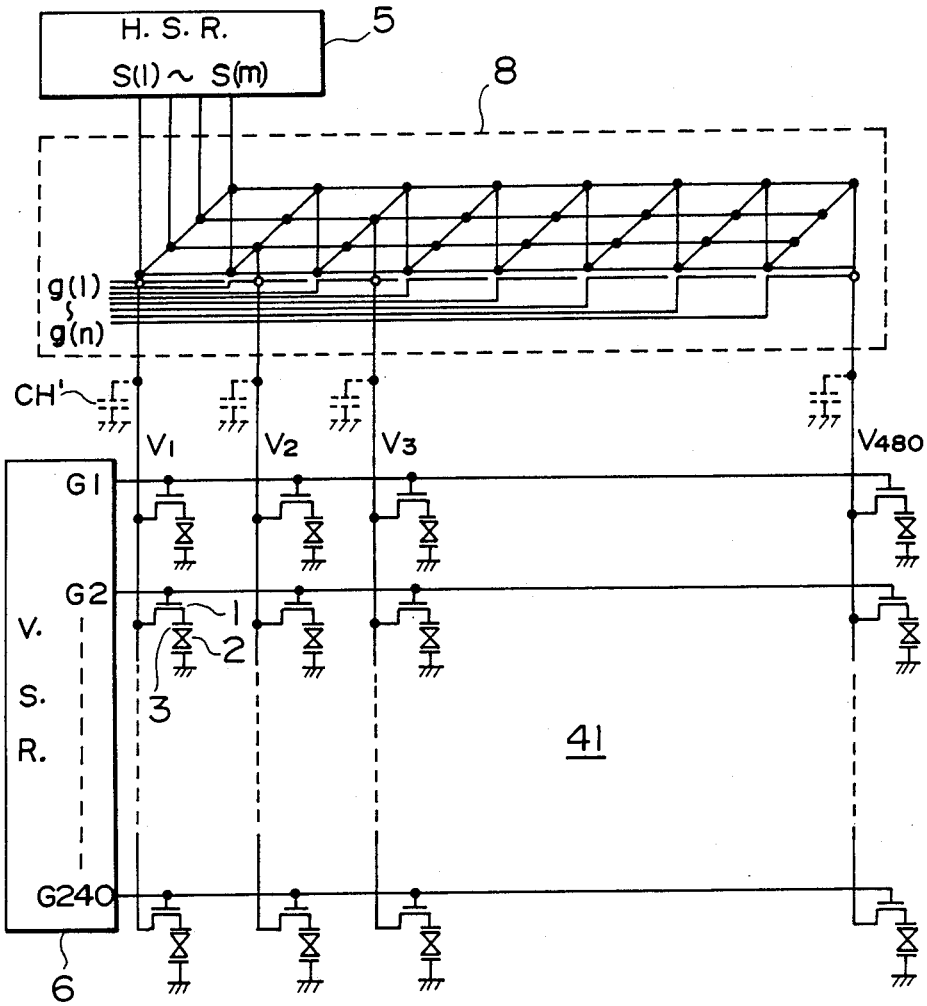
FIG. 4 shows a display panel comprising a circuit of analog switches arranged in blocks.
Figure 5:
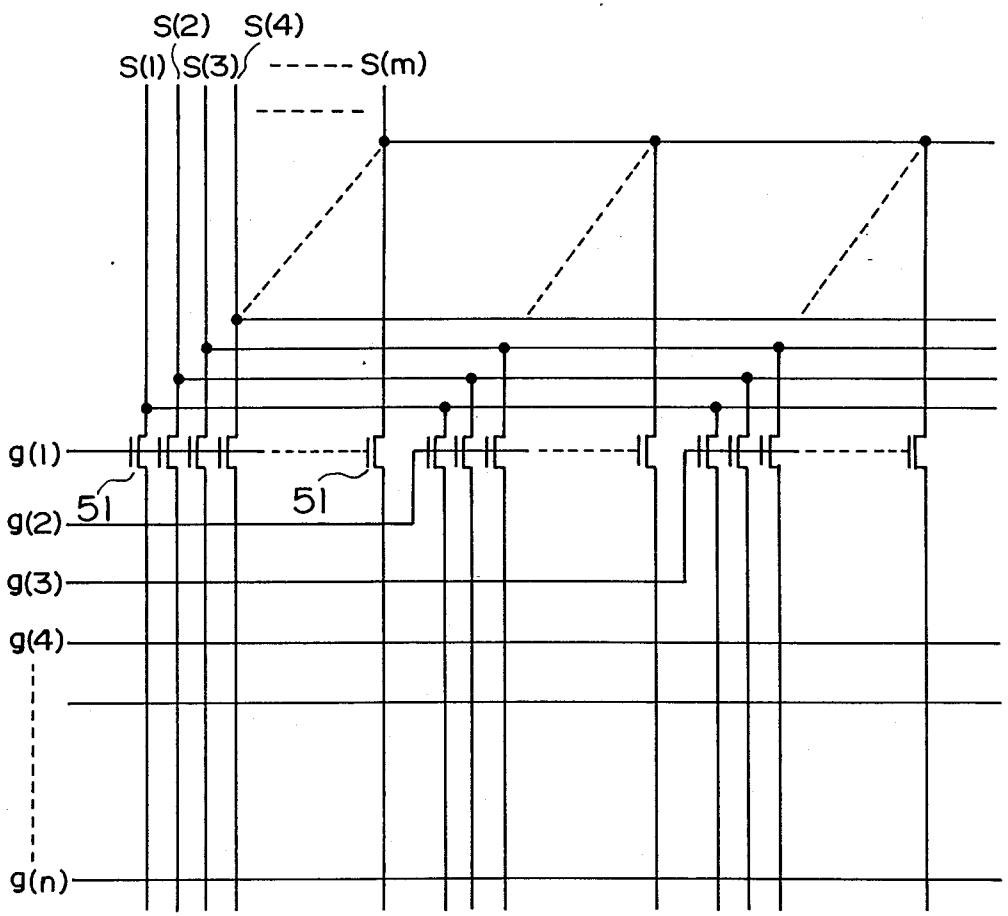
FIG. 5 shows the details of the analog switches arranged in blocks.

In a preferred embodiment according to the invention, the analog switches 8 are divided into an arbitrary plural number of blocks and the analog switches of one block are commonly driven. FIG. 4 shows a display panel comprising a circuit of analog switches 8 and a display zone 41, wherein g(1)–g(n) indicate signal lines for switching their respective blocks. FIG. 5 shows the details of analog switches 8 using an array of analog switching transistors 51.

As described above, according to the present invention, a liquid crystal display panel can be driven by using capacitive components formed of electrodes and a liquid crystal cell and without using capacitors which have been exclusively used for holding image signals. Accordingly, the panel structure can be simplified and the number of production steps can be decreased. Further, it is also advantageous that the panel area can be effectively used.

What is claimed is:

1. An active matrix-type display panel, comprising:

a liquid crystal panel comprising:

a first base plate having thereon:

a plurality of thin film transistors arranged in the form of a matrix comprising rows and columns;

a plurality of horizontal lines each commonly connected to the gates of thin film transistors in a row;

a plurality of vertical lines each commonly connected to the sources of the thin film transistors in a column; and a plurality of pixel electrodes each connected to the drain of a thin film transistor;

a second base plate having thereon a counter electrode; and a liquid crystal disposed between the first and second base plates;

a scanning-side driving circuit provided with a first shift register;

an information-side driving circuit provided with a second shift register;

a plurality of capacitive elements respectively connected to the vertical lines for sampling-and-holding information signals, each capacitive element being formed between one of the vertical lines and the counter electrode with the liquid crystal disposed therebetween and having a capacitance at least thirty times the capacitance formed between one pixel electrode and the counter electrode with the liquid crystal disposed therebetween;

a plurality of analog switching transistors disposed between said second shift register and said capacitive elements for holding the information signals at said respective capacitive elements for one scanning period for scanning a row of the transistors; and said plurality of analog switching transistors being divided into a plurality of blocks each comprises a plurality of analog switching transistors, the gates of which are commonly connected to a switching line, and the sources of which are connected to data lines leading to the second shift register in such a manner that the sources of the analog switching transistors in each block are respectively connected to one of the data lines, and wherein a group of the sources of the analog switching transistors each belonging to a different block are commonly connected to one of the data lines.

2. The display panel according to claim 1, wherein said capacitive element for sampling-and-holding information signals has a capacitance of the order of 3–10 pF.

3. The display panel according to claim 1, wherein said analog switching elements comprise thin film transistors.

4. The display panel according to claim 1, wherein the liquid crystal panel comprises 480 or more of the vertical lines and 240 or more of the gate lines.

5. The display panel according to claim 1, wherein said counter electrode has thereon a plurality of metal electrodes each functioning as a counter electrode comprising one of the capacitive elements in combination with one of the vertical lines and disposed in alignment with said one of the vertical lines.

6. The display panel according to claim 5, wherein each metal electrode has substantially the same width as said one of the score lines.

* * * * *